United States Patent [19]

Token et al.

[11] Patent Number: 4,461,343

[45] Date of Patent: Jul. 24, 1984

[54] PLATED HEAT PIPE

[75] Inventors: Kenneth H. Token, St. Charles; Edward C. Garner, University City, both of Mo.

[73] Assignee: McDonnell Douglas Corporation, Long Beach, Calif.

[21] Appl. No.: 343,534

[22] Filed: Jan. 28, 1982

[51] Int. Cl.[3] ..... F28D 15/00

[52] U.S. Cl. ..... 165/104.26; 165/104.33; 165/133; 165/80 C; 29/157.3 R; 29/157.3 H; 427/290; 427/327

[58] Field of Search ..... 165/104.26, 133, 104.33, 165/80 C; 29/157.3 R, 157.3 H; 427/290, 327

[56] References Cited

U.S. PATENT DOCUMENTS

| | | | |
|---|---|---|---|
| 1,223,777 | 4/1917 | Eby . | |
| 3,485,296 | 12/1969 | Lazaridis et al. | 165/133 |
| 3,508,603 | 4/1970 | Plevyak | 165/80 C |
| 3,568,762 | 3/1971 | Harbaugh | 165/105 |
| 3,613,778 | 10/1971 | Feldman, Jr. | 165/104.26 |
| 3,680,189 | 8/1972 | Noren | 165/104.26 |
| 3,769,689 | 11/1973 | Little | 29/498 |
| 3,789,920 | 2/1974 | Kalkbrenner | 165/105 |
| 3,821,842 | 7/1974 | Bergman et al. | 29/460 |
| 3,834,457 | 9/1974 | Madsen | 165/104.26 |
| 4,015,659 | 4/1977 | Schladitz | 165/105 |
| 4,118,756 | 10/1978 | Nelson et al. | 165/104.33 |
| 4,135,013 | 1/1979 | Yamaguchi et al. | 427/405 |
| 4,231,423 | 11/1980 | Haslett | 165/133 |

*Primary Examiner*—Albert W. Davis, Jr.
*Attorney, Agent, or Firm*—Paul T. Loef; George W. Finch; Donald L. Royer

[57] ABSTRACT

A heat pipe formed by metal deposition, on porous metal wick parts, which forms the enclosure and provides both a metallurgical bond to the wick and a hermetic seal.

7 Claims, 12 Drawing Figures

PLATED HEAT PIPE

BACKGROUND OF THE INVENTION

This invention relates to heat pipes and, more particularly, to heat pipes having an integral metallic bond between the porous wick and the metal skin or case.

Typically, a heat pipe is comprised of a hermetic enclosure or case containing a porous capillary structure normally called a wick, a void volume, and a working fluid. The wick contains the liquid phase of the working fluid. The void volume of the container not occupied by the wick contains saturated working fluid vapor.

Heat pipes transfer heat internally by mass transfer. The working fluid vaporizes wherever heat is added and then flows to wherever heat is removed. The working fluid condenses where heat is removed and this liquid is returned to where heat is added by capillary action in the wick. Heat is added in the section of the heat pipe normally referred to as the evaporator and heat is released in the section of the heat pipe normally referred to as the condenser.

A large temperature drop encountered in heat pipes occurs in both the evaporator and condenser sections where heat is conducted through the enclosure or case, the enclosure-to-wick interface, and through the wick and working fluid. Thermal resistance at the enclosure-to-wick interface is a significant portion of the overall heat pipe temperature drop.

Prior art methods of heat pipe manufacture begin with pre-formed, i.e. extruded or machined, enclosure and may be more than one piece. Great care must be used to place the wick material at desired locations. Means must be provided to tightly press the wick pieces against the enclosure surfaces (as by springs, welding, diffusion bonding, etc.) in order to minimize the enclosure-to-wick thermal resistance. For the enclosures made of several pieces, normally done to provide access during wick placement, the final hermetic seals are typically accomplished by welding, brazing, or soldering the enclosure pieces together. This technique is susceptible to leakage at the joints which, of course, leads to heat pipe failure.

Prior art heat pipes are typically expensive to manufacture due to labor intensive wick placement and retention, are susceptible to failure due to leakage at the various joints in the enclosure, and can exhibit degraded performance because of high enclosure-to-wick thermal resistance.

It is an object of this invention to produce a hermetically sealed heat pipe enclosure having a metallurgical bond to the internally contained wick to insure low enclosure-to-wick thermal resistance.

It is a further object of this invention to produce an inexpensive heat pipe without joints or seams, except at the point where provision is made for adding the working fluid, usually a tube, in order to reduce susceptability to leaks.

SUMMARY OF THE PRESENT INVENTION

In summary, the heat pipe of this invention accomplishes the above objects and overcomes the disadvantages of the prior devices by providing a heat pipe by some type of metal deposition on one or more porous parts or combinations of porous parts and solid parts. The parts must be maintained in the correct relative orientation to each other during the metalizing process.

The heat pipe enclosure is formed by bridging the pores in the porous materials and the joints between the metal pieces. The process forms a continuous metal hermetic seal over the entire exterior of the heat pipe and increases its structural integrity. This hermetic container forms a one piece case around all exterior surfaces of the wick and other parts and provides a metallurgical bond between the porous wick and the case so formed.

BRIEF DESCRIPTION OF THE DRAWINGS

With reference to the drawings, wherein like reference numerals designate like portions of the invention.

DESCRIPTION OF THE PREFERRED EMBODIMENT

Figure 1:
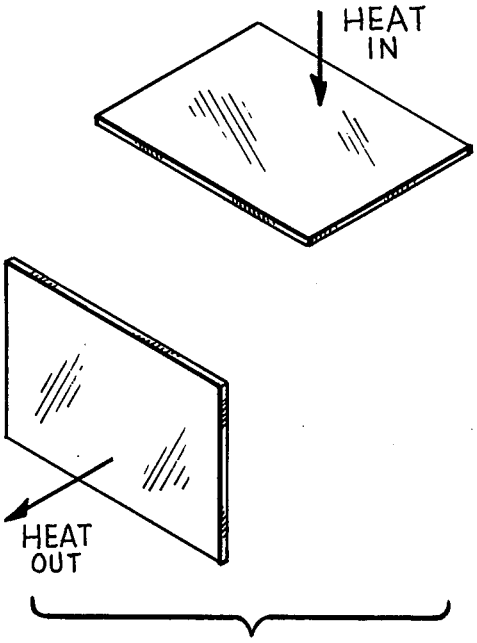
FIG. 1 shows two surfaces oriented at 90° to each other and displaced to represent desired "heat in" and "heat out" surfaces.

Typically, to enjoy the benfits of the disclosed invention, the heat pipe enclosure may be configured to any desired shape to meet the requirements of the specific application. However, typical requirements have been generated, as shown in FIG. 1, to produce a representative heat pipe configuration. FIG. 1 shows "heat in" and "heat out" surfaces (which may or may not be planar), oriented 90° to each other, as a typical requirement.

Figure 3:
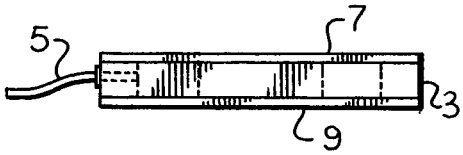
FIG. 3 shows the elements of FIG. 2 in an end view after joining.
Figure 2:
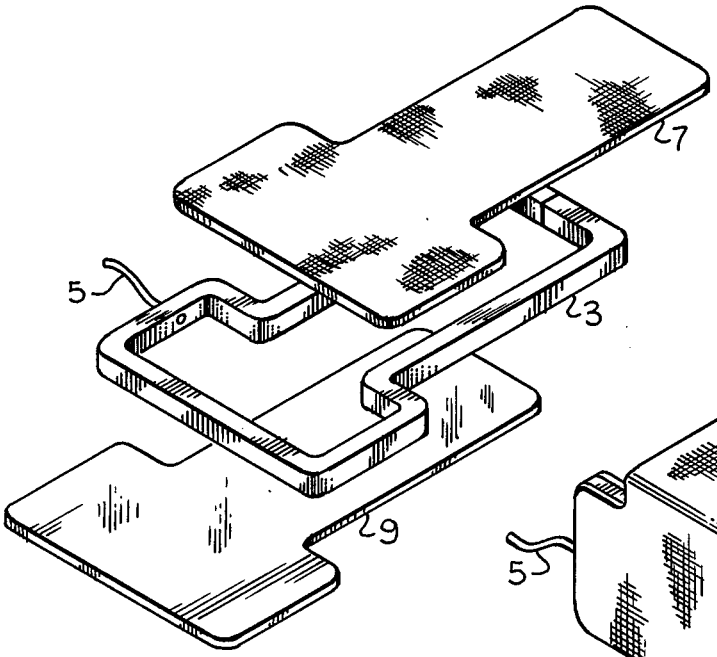
FIG. 2 shows a sheet of wick material, a bent bar stock frame, and a piece of sheet metal cut or shaped to a desired form, in perspective, stacked arrangement for further processing into the heat pipe.
Figure 4:
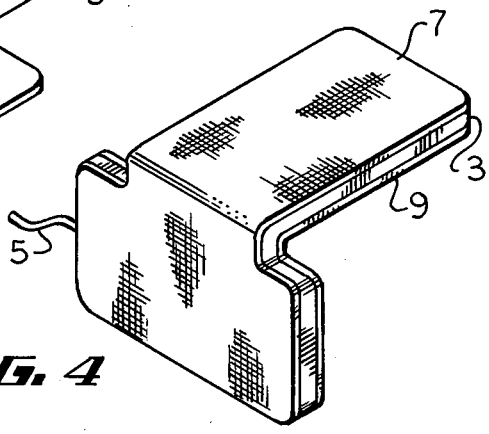
FIG. 4 shows a perspective of the bent assembly.

FIG. 2 shows the heat pipe components required to satisfy these requirements, in a stacked isometric relationship, prior to assembly. A frame 3 is made from solid stock bent to the required shape and is faced on either side by a porous wick 7 and a solid plate 9. The wick is shaped to match the contours of the "heat in" and "heat out" surfaces. A fill and clean tube 5 is shown projecting from the frame 3. The components are held together by any one of many alternate possibilities including: fusion bonding, clamping, brazing, soldering, or mechanical fasteners. The joined assembly is shown in FIG. 3. The fastened assembly is then bent as shown in FIG. 4 to match the "heat-in", "heat-out" requirements of FIG. 1.

The assembly is now subjected to a metal deposition process, e.g. plating or metal spraying to form the heat pipe enclosure, combining to form both structure and hermetic seal. The metal deposited in the deposition process bridges the pores in the porous material of the wick as well as the joints between metal pieces forming a continuous metal hermetic seal over the entire exterior of the heat pipe. At the same time, a metallurgical bond is established between the wick and the heat pipe enclosure, eliminating the wick-to-enclosure interface discussed above in the prior art.

The heat pipes fabricated to date have been made from all copper components and completed with a copper plating process. Copper was selected because of its high thermal conductivity, availability, cost, and it is conducive to the plating process. However, any material subject to the plating process (such as nickel, aluminum, silver, etc.) would be an acceptable candidate.

The clean and fill tube 5 is provided to clean the inside of the heat pipe after fabrication and for final filling with the working fluid. It may be advantageous to provide multiple tubes to allow a flushing action during cleaning. A vacuum is normally drawn on the heat pipe prior to injecting the working fluid during the filling process, and this may also be done through the fill tube(s).

Figure 5:
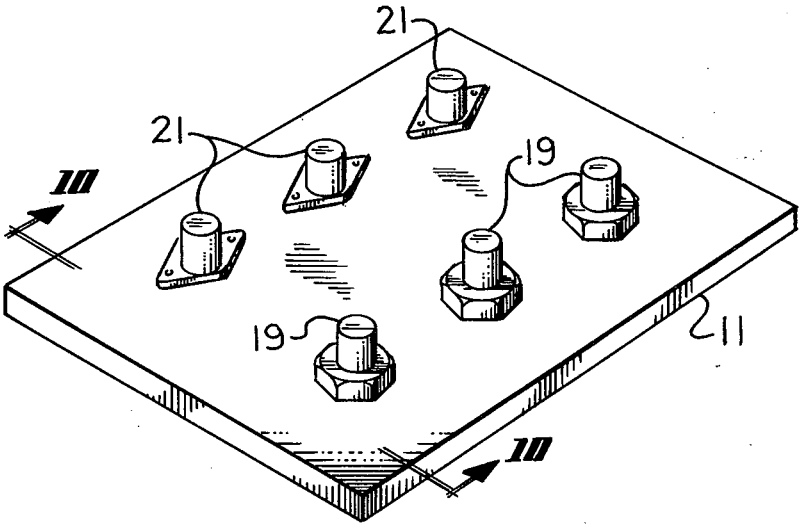
FIG. 5 shows both flange mounted transistors and stud mounted transistors in the evaporator section of the heat pipe.
Figure 6:
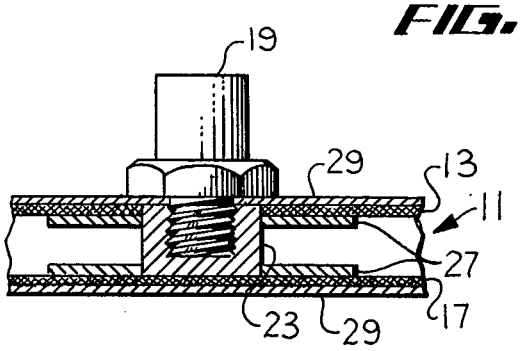
FIGS. 6 and 8 show sections of the two types of transistors.
Figure 7:
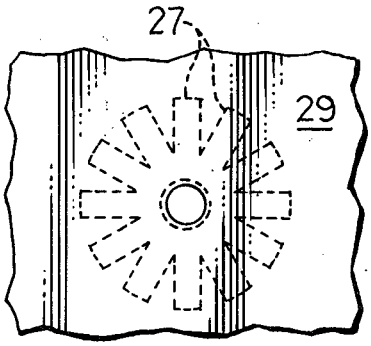
FIG. 7 shows a star-shaped washer for better heat conduction.
Figure 8:
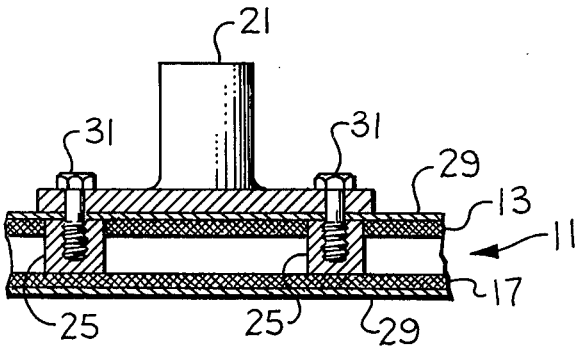
Figure 9:
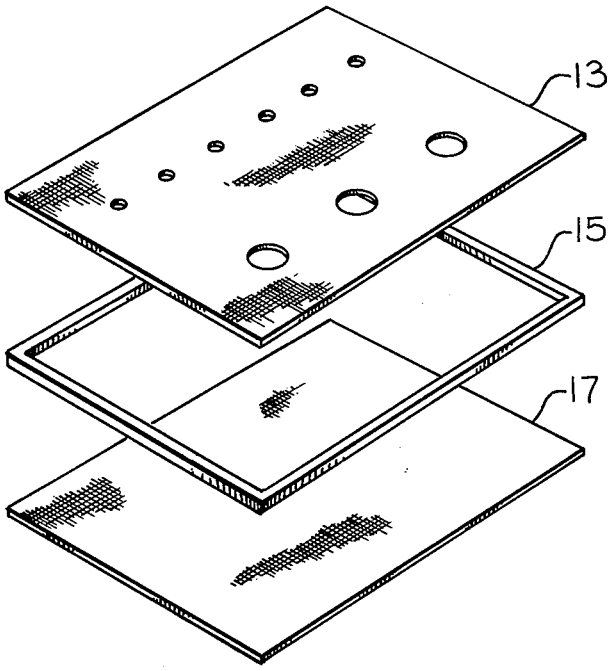
FIG. 9 is a perspective, exploded view, prior to assembly of the heat pipe, shown assembled in FIG. 5.
Figure 10:
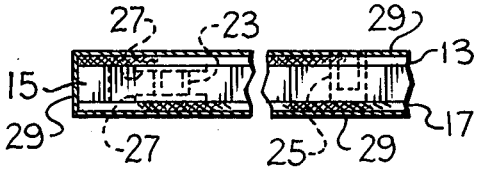
FIG. 10 is a partial cross section view of the assembly shown in FIG. 5 showing the internal mountings of the transistor.

FIG. 5 shows an alternative embodiment showing stud-mounted and flange-mounted transistors installed directly in the evaporator end of the heat pipe which may be called a cold plate and is used to cool power transistors. The completed heat pipe could well look similar to the heat pipe shown in FIG. 11. FIGS. 6 and 8 show cross sections of the installation of the two different transistors and the means for their support. Components, prior to assembly, are shown in FIG. 9 comprising an upper wick 13, a rectangular frame 15 and a lower wick 17. Holes are provided in the upper wick 13 to accommodate the power transistors as well as the receptacles. Stud receptacle 23 is provided to accommodate the stud-type mounting and flange receptacles 25 are provided to accommodate the flange-mounted transistors. The upper wick 13, the rectangular frame 15 and the lower wick 17 are maintained in stacked relationship with the receptacles 23 and 25, depending on the type of transistor, maintained in their proper place while the entire assembly is subjected to a metal deposition process to deposit the metal layer 29 which also forms a hermetic seal. After completion of the metal deposition process, transistors are inserted by threading into the receptacle 23 in the case of the stud-mounted transistor and by the bolts 31 in the case of the flange mounted transistor.

Figure 11:
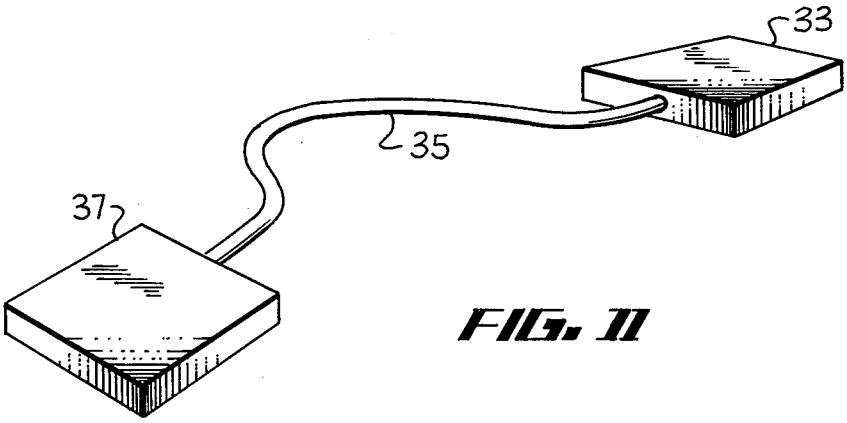
FIG. 11 shows an evaporator and condenser connected by a cylindrical tube made from wick material and then the entire assembly plated to form the completed heat pipe.

FIG. 11 is a simple heat pipe with an evaporator or chill plate section 33 followed by an adiabatic section 35 and a condenser 37. The various components would be assembled as discussed above, connected by the adiabatic section 35, and the entire system plated or subjected to a metal deposition process to form the hermetic seal and bond between the outer case and the wick of the heat pipe. The chill plate or evaporator section 33 could be configured as shown in FIG. 9, i.e. to accommodate the transistors. The shaped adiabatic tube section 35 connecting the evaporator 33 and condenser 37 can be fabricated in different ways. The wick material may be rolled to form a cylindrical cross section, then formed to the required shape, and attached to the evaporator and condenser and the entire assembly subjected to the metal deposition process. Alternately, the adiabatic section may be formed to its final shape after plating. Another alternative is to insert a rolled wick in the tubing which is then attached to the evaporator and condenser sections for plating. The adiabatic section need not necessarily have a metallurgical bond between the tube and the wick if no heat transfer takes place there.

Another alternative available is diffusion bonding of the assembly, however, the filler tube may be plated separately with the wick inserted inside the tube.

Figure 12:
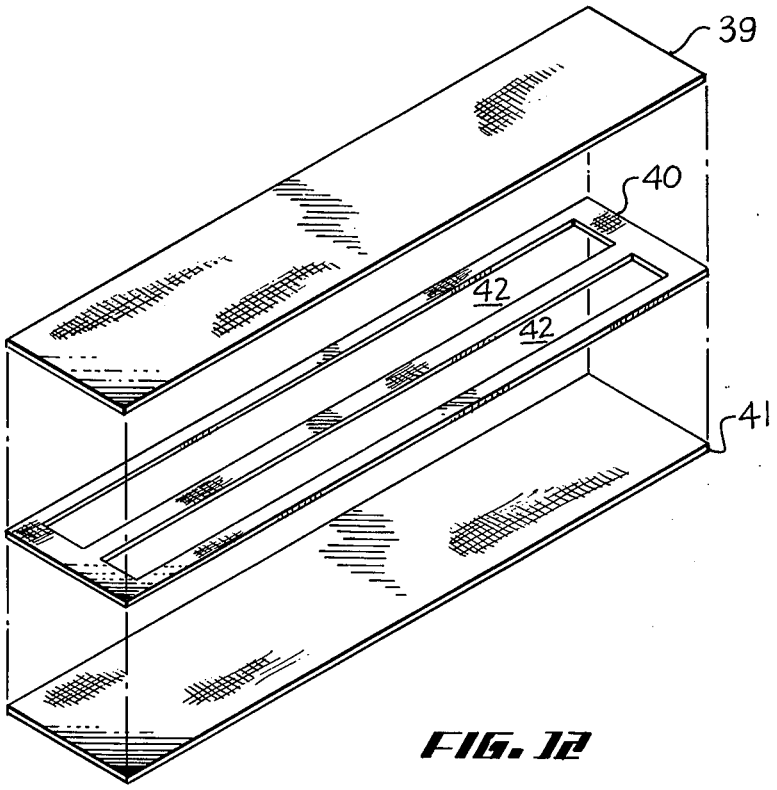
FIG. 12 is an exploded view of an alternate embodiment using three sheets of wick material to form the heat pipe.

An alternative embodiment is shown in FIG. 12 where the heat pipe is constructed by plating three stacked sheets of wick material 39, 40, and 41 where apertures are provided in the inner wick to provide vapor passages 42 as desired.

It should now be reasonably apparent that the preformed assemblies may consist of any desired combination of one or more pieces, either porous or solid. The plating process has been found to bridge the pores in porous materials and the joints between metal pieces thereby forming a continuous metal hermetic seal of the entire exterior of the heat pipe. Heat pipes manufactured by this process can be used to improve the thermal performance and reduce the cost for almost all known heat pipe applications.

This invention is not limited to the embodiments disclosed above, but all changes and modifications thereof not constituting deviations from the spirit and scope of this invention are intended to be included.

What is claimed is:

1. A heat pipe comprising:

a single walled case having an internally contained capillary wick which is metallurgically bonded to said case;

a vapor space adjacent said wick;

a working fluid;

means to fill said heat pipe with said working fluid; and said case having no seams other than at said means to fill said heat pipe with said working fluid.

2. The heat pipe of claim 1 wherein said case has an integral means to support and hold heat dissipating devices.

3. The heat pipe of claim 1 wherein said case, wick and means to fill said heat pipe with said working fluid are made of copper.

4. A method of making a heat pipe comprising:

shaping porous wick material to the desired shape of the finished heat pipe;

attaching means to fill said heat pipe with working fluid to said porous wick; and subjecting said porous wick material and said attached means to fill said heat pipe to a metal deposition process to form an enclosure by bridging the pores in said porous wick material and the joint between said wick material and said means to fill said heat pipe, whereby forming a continuous metal hermetic seal over the entire exterior of said heat pipe.

5. The method of making a heat pipe as recited in claim 4, further comprising shaping said porous wick material to form a spacing frame and stacking either a solid metal or porous material adjacent either side of said porous wick shaped to form a spacing frame before the metal deposition process.

6. The method of making a heat pipe as recited in claim 4 or 5, further comprising:

cleaning the inside of said heat pipe by purging via said means to fill said heat pipe;

filling said heat pipe with working fluid; and sealing said means to fill said heat pipe.

7. The heat pipe of claim 1 wherein said capillary wick has a metal screen outer surface.

* * * * *